US011603752B2

(12) United States Patent
Nash

(10) Patent No.: US 11,603,752 B2
(45) Date of Patent: Mar. 14, 2023

(54) DOWNHOLE RATCHET MECHANISM AND METHOD

(71) Applicant: KNJB, INC., Houston, TX (US)

(72) Inventor: Kenneth L Nash, Houston, TX (US)

( * ) Notice: Subject to any disclaimer, the term of this patent is extended or adjusted under 35 U.S.C. 154(b) by 61 days.

(21) Appl. No.: 17/058,839

(22) PCT Filed: May 29, 2019

(86) PCT No.: PCT/US2019/034325
§ 371 (c)(1),
(2) Date: Nov. 25, 2020

(87) PCT Pub. No.: WO2019/232006
PCT Pub. Date: Dec. 5, 2019

(65) Prior Publication Data

US 2021/0207469 A1 Jul. 8, 2021

Related U.S. Application Data

(60) Provisional application No. 62/677,955, filed on May 30, 2018, provisional application No. 62/683,226, filed on Jun. 11, 2018, provisional application No. 62/689,430, filed on Jun. 25, 2018, provisional application No. 62/821,006, filed on Mar. 20, 2019.

(51) Int. Cl.

| | |
|---|---|
| ***E21B 44/04*** | (2006.01) |
| ***E21B 7/04*** | (2006.01) |
| ***E21B 17/10*** | (2006.01) |

(52) U.S. Cl.
CPC ..... *E21B 44/04* (2013.01); *E21B 7/04* (2013.01); *E21B 17/1078* (2013.01)

(58) Field of Classification Search
CPC ..... E21B 44/04; E21B 7/04; E21B 17/1078
See application file for complete search history.

(56) References Cited

U.S. PATENT DOCUMENTS

2005/0211473 A1* 9/2005 Zupanick ..... E21B 7/067 175/107

FOREIGN PATENT DOCUMENTS

WO WO-2004109052 A2 * 12/2004 ..... E21B 17/00

* cited by examiner

*Primary Examiner* — Dany E Akakpo
(74) *Attorney, Agent, or Firm* — Kenneth L. Nash; Thomas D. Nash

(57) ABSTRACT

A downhole ratchet is utilized between tubulars in the drill string to reduce torsion energy in the drill string. The downhole ratchet is constructed to release when the tubular below the ratchet spins faster than the tubular above the ratchet. When the tubular below spins more slowly or at the same speed then the ratchet mechanism locks the upper and lower tubulars together to rotate the bit. The effect is to release torsional energy in the drill string to reduce and eliminate slip stick oscillations.

13 Claims, 3 Drawing Sheets

DOWNHOLE RATCHET MECHANISM AND METHOD

BACKGROUND OF THE INVENTION

Field of the Invention

The present invention relates generally to a downhole ratchet for a drill string that allows torsional energy in the drill string to be released.

Description of the Background

Slip-stick (stick-slip) occurs when the bit grabs the formation and then releases. Due to the torsional energy in the drilling string during drilling, oscillations of slowing and speeding of the drill bit can occur. Full blown slip-stick results in the bit actually stopping. When the bit is released, the bit begins spinning at high speeds sometimes much higher than the drilling speed. The oscillation can continue indefinitely. Even at much lesser variations below full blown slip-stick, the drill string actually shortens and lengthens, which produces changes in the axial length of the drill string. The shortening and lengthening of the drill string can cause poor cutting and damage to the bits.

Slip-stick is a problem that damages the bits as they are bounced up and down on the bottom of the wellbore (bit bounce), slowing drilling due to poor cutting during Slip-stick, increasing the number of bit trips, damaging the wellbore, causing an irregular well bore, causing circulation problems, decreasing the control of the direction of drilling, decreased cementing reliability due to the presence of one or more elongated troughs, clearance problems for gravel packing screens and other problems.

In some cases, full blown stick-slip at the lower portion of the drill string miles below the surface especially in higher angle holes or deeper holes is not readily detectable with surface sensors. Therefore surface controls to vary drilling speed to counteract the stick-slip may not be effective.

Because modern PDC cutting elements of bits have a very short length and must be held in constant close contact for maximum cutting effect, even small axial changes in the length of the drill string can significantly impede drilling progress. Bit bounce can increase bit wear and require more frequent bit trips. Bit bounce also damages the well bore.

Whenever the drill bit is rotated for drilling into a formation, the drill string has torsional windup or torsional potential energy, just as a torsional spring might have when torque is applied thereto. When drilling, it is highly desirable that this torsional windup or potential energy be a constant value based on the torsional constant of the drill string, and not a varying or oscillating amount, which occurs with slip-stick.

The irregular drilling due to slip-stick damages the drilling string and damages the wellbore. Torsional vibrations may produce a twisted borehole that becomes the source for additional torque. Thus, the problem of torsional vibrations is self-reinforcing. For many reasons, it is desirable to drill a straighter hole with reduced spiraling effects along the desired drilling path.

For instance, it has been found that tortuosity, or spiraling effects frequently produced in the wellbore during drilling, is associated with degraded bit performance, bit whirl, an increased number of drill string trips, increased likelihood of losing equipment in the hole, increased circulation and mud problems due to the troughs along the spiraled wellbore, increased stabilizer wear, decreased control of the direction of drilling, decreased cementing reliability due to the presence of one or more elongated troughs, clearance problems for gravel packing screens, decreased ROP (rate or speed of drilling penetration), degraded logging tool response due to hole variations including washouts and invasion, decreased reliability of MWD (measurement while drilling) and LWD (logging while drilling) due to the vibrations generally associated therewith, and many other problems.

It would be desirable to maintain torsional potential energy at a constant value. This maintains the constant close contact of the drill bit with the surface to be cut for maximum cutting effects. It would be desirable to provide a tool that would stabilize torsional potential energy within a few cycles:

While systems that use surface controls to balance torsional potential energy are to some extent effective, they are limited in that energy variations must travel all the way to the surface to even be detected. The deeper the well, the higher the drilling angle, the less likely this is to occur which limits usefulness of surface controls.

Consequently, there remains a need to provide an improved downhole assembly to perform this function and keep the torsional potential energy of the drill string constant. It would be desirable to provide a tool that would drain energy from the drill string when the drill bit turns faster than the drilling rate but then immediately apply driving energy to the drill bit when the bit drops back to the drilling driving rate velocity rate. This effect would quickly stabilize the bit drilling speed, maximize bit life, maximize drill sting life, and improve the hole. It would be desirable that the tool be relatively inexpensive and simple. Those of skill in the art will appreciate the present invention which addresses the above problems.

SUMMARY OF THE INVENTION

Accordingly, it is an objective of the present invention to provide an improved drilling assembly and method.

Another objective of one embodiment of the present invention is to decay torsional pulses going up the drill string to stabilize torsional potential energy in the drill string.

Another objective of the present invention is to release the lower portion of a drillstring to stabilize torsional potential energy in the drillstring.

Another objective of the present invention is to limit axial lengthening/shortening oscillation of the drill string to the point where bit bounce is eliminated—for longer bit life and improved positioning of the PDC cutters to maximize drilling rate.

An objective is to provide faster drilling ROP (rate of penetration), longer bit life, and reduced stress applied to the drill string.

A feature of the present invention is a ratchet that allows the drill string below the ratchet to spin to release torsional energy and then drives the drill string as soon as it slows down.

An advantage of use of the present invention in the drillstring is faster drilling ROP (rate of penetration), longer bit life and reduced stress applied to the drill string.

Other examples of advantages include but are not limited to reduced stress on drill string joints, truer gauge borehole, improved circulation, improved cementing, improved lower noise MWD and LWD, improved wireline logging accuracy, improved screen assembly running and installation, fewer bit trips, reduced or elimination of tortuosity, reduced or elimination of drill string buckling, reduced hole washout, improved safety, and/or other benefits.

These and other objectives, features, and advantages of the present invention will become apparent from the drawings, the descriptions given herein, and the appended claims. However, it will be understood that the above-listed objectives, features, and advantages of the invention are intended only as an aid in understanding aspects of the invention, and are not intended to limit the invention in any way, and therefore do not form a comprehensive or restrictive list of objectives, and/or features, definitions, and/or advantages of the invention.

One general aspect includes a ratchet connectable in a drilling string to release torsional energy from said drilling string when drilling a wellbore, said drilling string extending from the surface to a drill bit, said ratchet being connectable between a first tubular and a second tubular in said drilling string, said ratchet including: a body; a first threaded connection on said body, said first threaded connection being threadably connectable with said first tubular; a first component mounted for rotation with respect to said body, a second threaded connection on said first component, said second threaded connection being threadably connectable with said second tubular; and a second component, said first component and said second component being mechanically linked to lock said first and second tubulars together when said second tubular rotates at a velocity equal to or less than said first tubular, and permit relative rotation between said first and second tubulars when said second tubular rotates at a velocity greater than said first tubular to thereby release torsional energy from said drilling string.

DETAILED DESCRIPTION

Figure 1:
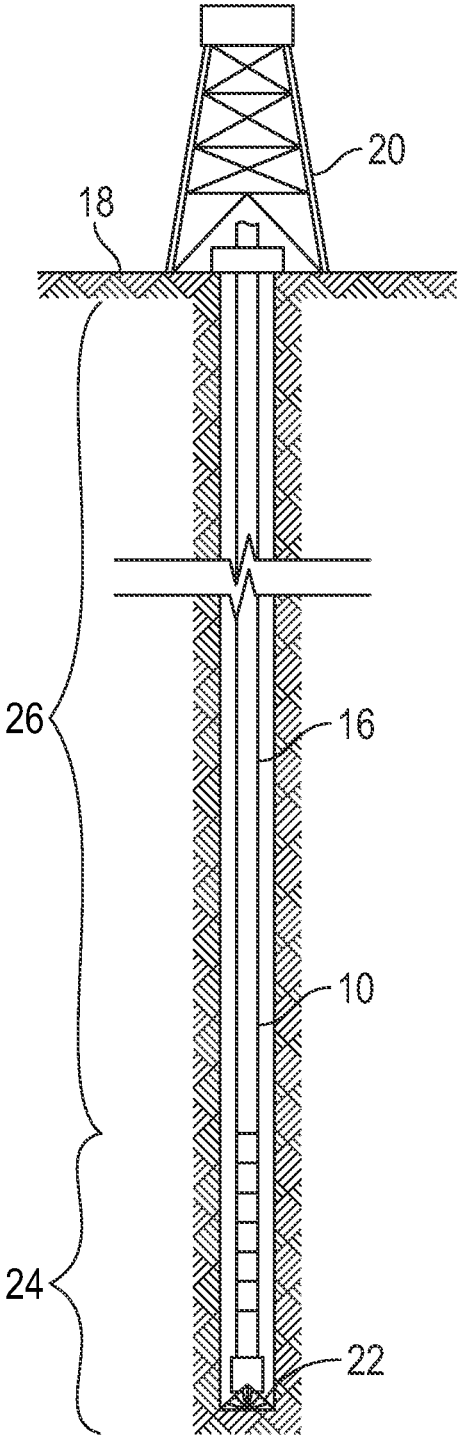
FIG. 1 discloses a drill string and one or more slip mechanisms located at selected positions in the drill string in accord with one possible embodiment of the invention.
Figure 2:
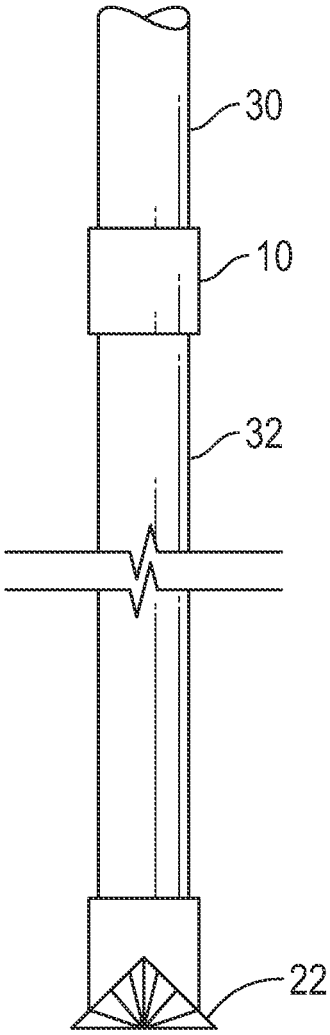
FIG. 2 discloses a ratchet mounted in the drill string between a first tubular, which may be an upper tubular, and a second tubular, which may be a lower tubular in the drill string in accord with one possible embodiment of the invention.

FIG. 1 shows a drill string 16 in which ratchet 10 could be mounted as shown in FIG. 2. Slip mechanisms may also be referred to herein as ratchet mechanisms or the like. The drill string 16 extends from an earth surface 18 to the drill bit 22. Surface drive 20 applies torque to rotate the drill sting to rotate the bit. Alternatively, the bit 22 may be driven by a downhole motor.

The drill string 16 comprises a bottom hole assembly (BHA) 24 and a pipe string 26. The pipe string may also be referred to as a drill pipe portion or other related terminology. The BHA 24 is at a lowermost position in the drill string 16. The BHA 24 comprises a bit and components such as a bit sub, drill collar, heavyweight drill collar, heavy weight drill pipe, stabilizer, reamer, shock, hole opener, downhole motor, rotary steerable system, directional equipment, drilling while measurement equipment, steering unit, near bit inclination, and/or non-magnetic drill collar. While in FIG. 1 a top drive or rotary table drive on the surface is utilized to rotate the drill string, many wells are drilled with a downhole motor.

The BHA is connected to the drill pipe portion 26 of the drillstring. The drill pipe portion 26 comprises additional components such as drill pipe, coiled tubing, heavyweight drill pipe, and/or stabilizer. The drill pipe portion 26 of the drill string is typically much longer than the BHA. Where the BHA may typically be in the range of 100 to 400 feet, the drill pipe portion 26 of the drill string may be several miles long.

During normal drilling, the slip mechanism 10 operates the same as other tubulars in the drill string to convey power from the top drive to the drill bit. When Slip-stick occurs so that the drill bit sticks and then comes loose, the bit accelerates to a higher rotation velocity than the drill string velocity driven by the top drive, rotary table or downhole motor. At this time, the slip mechanism 10 allows the tubulars below to rotate independently with respect to the tubular above.

Figure 3:
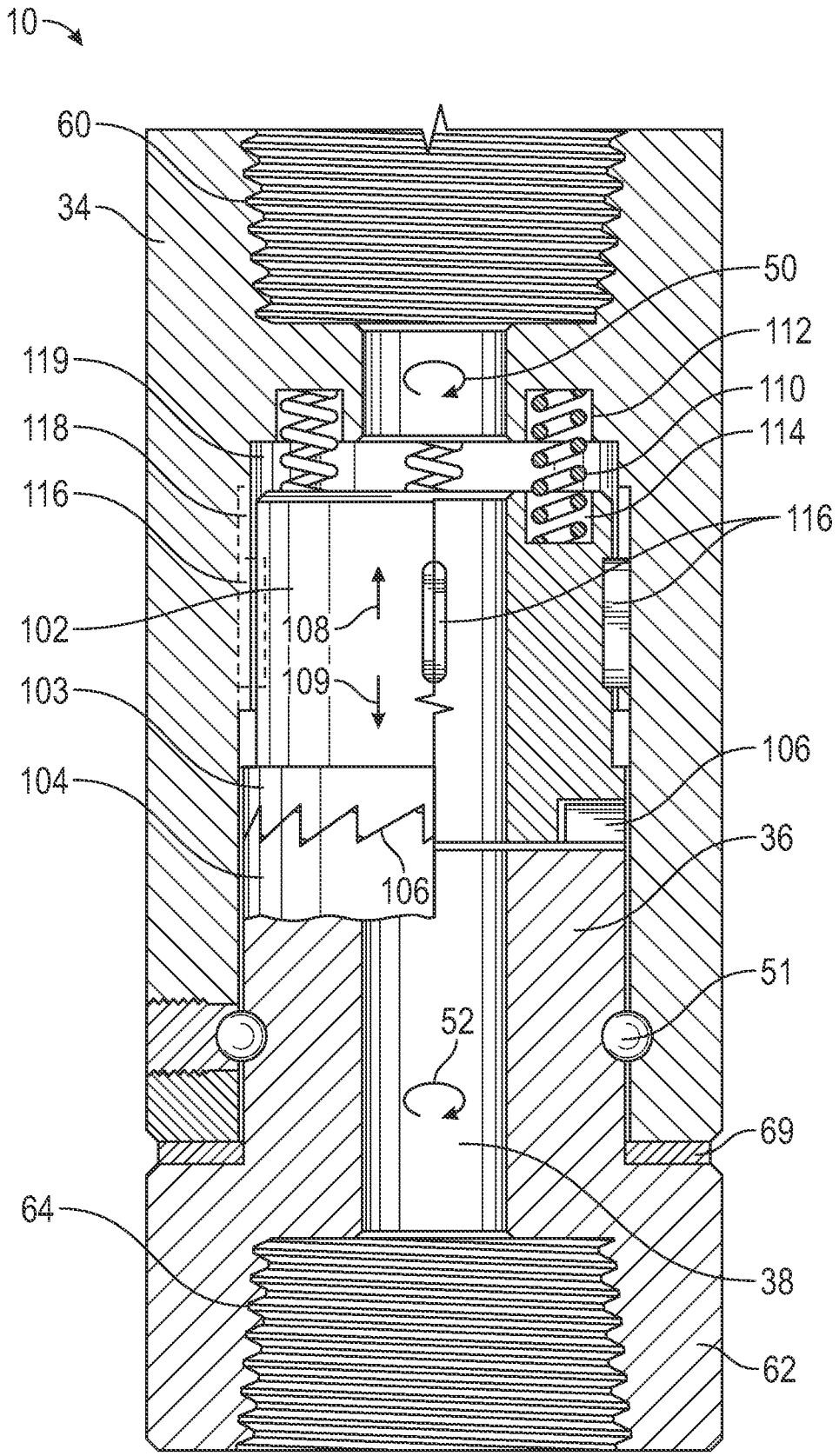
FIG. 3 is an elevational view, partially in cross-section, of a downhole ratchet showing a vertical extent thereof in accord with one possible embodiment of the present invention.

FIG. 3 shows slip mechanism 10, a type of ratchet, that comprises slidably mounted upper gear 102, 103 and lower gear 104 that grip upper tubular 30 (FIG. 2) and lower tubular 32 (FIG. 2) and allow/prevent rotation. As explained previously, slippage depends on the relative velocity of outer body 34 and inner body 36 and lower portion 62 thereof as indicated by rotational arrows 50, 52. A flow path 38 is provided that extends through 10. Ball type bearings 51 are utilized to connect upper tubular to outer body 34 to inner body 36. Thrust bearing 69 provides a bearing for downward weight. When the velocity of lower tubular 32 (secured to threaded connection 64) is faster than upper tubular (secured to threaded connection 60) then upper gear 102 is pushed upwardly as indicated by arrow 108 against the bias provided by springs 110. Springs 110 are mounted in pockets such as pocket 112 in outer body 34 and in pocket 114 in moveable gear 103. Note that connectors 60 and 64 may be male or female and more typically connector 60 is female and connector 64 is male. When the velocity of lower tubular 32 is less than or equal to upper tubular 30 then upper gear 102 moves downward due to the bias as indicated by arrow 109. Upper gear 102 cannot rotate with respect to outer body 34 due to splines 116 that engage corresponding grooves 118 shown in dash.

It will be appreciated for the claims that the terms first component and second component are for convenience and that either of the inner or outer body could be called a first component or second component. The inner body or outer body may also be referred to as an inner tubular or outer tubular.

One advantage of downhole ratchet 10 is that very few moving parts are required. The drive force to rotate the bit is transmitted by teeth 106 on the two opposing gears.

Accordingly, the upper gear 102 moves up and down in the pocket 119. However upper gear 102 is biased downwardly. It will be appreciated that many types of springs may be utilized instead of coil springs as shown. Outer body 34 is secured to the upper tubular 30 via threaded connection 60. The upper gear 102 has to rotate with the outer body 34 because the pocket 119 comprises splines 116. Because outer body 34 is threadably secured to the upper tubular 30, upper gear 102 is constrained to rotate with the upper tubular 30.

The lower gear 104 connects to the lower tubular 32 through threaded connection 64. The lower gear 104 cannot move axially up and down. During normal drilling, the upper gear 102 drives the lower gear 104, which drives the drill string below the slip mechanism 10.

If due to slip stick, lower gear 104 rotates faster than the upper gear 102 then the spring loaded upper gear 102 is pushed up and slipping occurs between upper gear 102 and lower gear 104 until the velocity of lower gear 104 drops to the driving speed of outer body 34.

This releases torque energy in the drill string to dampen out torque oscillations.

In other words, two saw-toothed gears 102, 104 with at least one gear 103 being spring loaded to press against each other with the toothed sides together. Rotating in one direction, the saw teeth of the drive disc lock with the teeth of the driven disc, making it rotate at the same speed. If the drive disc slows down or stops rotating, the teeth of the driven disc slip over the drive disc teeth and continue rotating.

Figure 4:
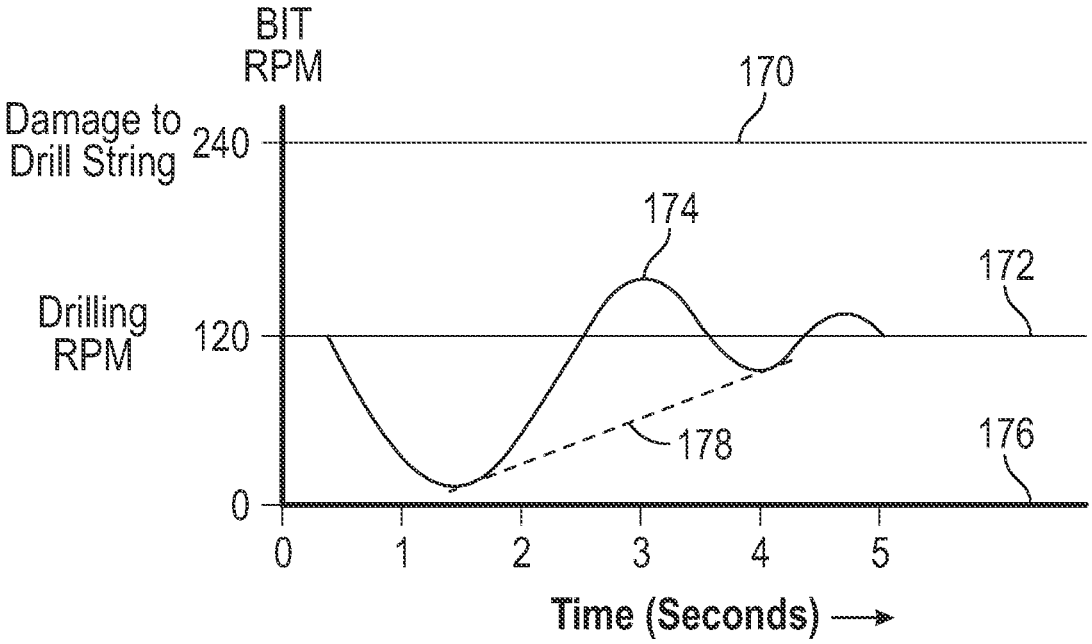
FIG. 4 shows damping of torsional oscillations resulting from placement of a slip mechanism at a first position in a drill string.

FIG. 4 shows the effect of damping of torsional vibrations in bit speed 174 (which may be closely related to the speed measured at lower tubular 32 or speed of inner body 36). Drilling speed 172 may be in the range of 120 RPM or so. The speed at which damage occurs in the drill string is shown at 170, which may be in the range of 240 RPM. Speed indicted at 176 could be in the range of zero RPM if full blown slip-stick is occurring.

As discussed, a type of slip system utilized herein is purely mechanical and may be referred to herein as purely mechanical slip systems, ratchet, or the like. This slip apparatus is connectable between an upper tubular and a lower tubular in the drilling string. This slip system utilizes components that are mechanically linked to lock upper and lower tubulars together when said lower tubular rotates at a velocity equal to or less than said upper tubular, and permit relative rotation between said upper and lower tubulars when said lower tubular rotates at a velocity greater than said upper tubular to thereby release torsional energy from said drilling string.

Many additional changes in the details, components, steps, and organization of the system, herein described and illustrated to explain the nature of the invention, may be made by those skilled in the art within the principle and scope of the invention. It is therefore understood that within the scope of the appended claims, the invention may be practiced otherwise than as specifically described.

The invention claimed is:

1. A downhole ratchet connectable in a drilling string to release torsional energy from said drilling string when drilling a wellbore, said drilling string extending from the surface to a drill bit, said downhole ratchet being connectable between a first tubular and a second tubular in said drilling string, said downhole ratchet comprising:

a first component, a first threaded connection on said first component, said first threaded connection being threadably connectable with said first tubular;

a second component mounted for rotation with respect to said first component, a second threaded connection on said second component, said second threaded connection being threadably connectable with said second tubular; and said first component and said second component comprising a mechanical arrangement that locks said first tubular and said second tubular together when said second tubular rotates at a velocity less than said first tubular, and permits further relative rotation between said first tubular and said second tubular when said second tubular rotates at a velocity greater than said first tubular to thereby release torsional energy from said drilling string.

2. The downhole ratchet of claim 1, further comprising a biased member that is urged to engage a gear tooth.

3. The downhole ratchet of claim 2, wherein said biased member is mounted for pivotal or axially movement.

4. The downhole ratchet of claim 1, wherein second tubular is mounted below said first tubular and whereby said second tubular is released for rotation by said mechanical arrangement when said second tubular rotates at a speed greater than said first tubular.

5. A downhole ratchet connectable in a drilling string to release torsional energy from said drilling string when drilling a wellbore, said drilling string extending from the surface to a drill bit, said downhole ratchet being connectable between an upper tubular and a lower tubular in said drilling string, said downhole ratchet comprising:

a first member and a biased member mounted between said upper tubular and said lower tubular, said biased member being urged into contact with said first member;

said first member and said biased member being connected to transfer torque from said upper tubular to said lower tubular when said lower tubular rotates at less than a rotational velocity of said upper tubular, wherein responsive to said lower tubular rotating faster than said upper tubular, said biased member is moveable with respect to said first member and permits further relative rotation between said upper tubular and said lower tubular.

6. The downhole ratchet of claim 5, wherein said first member comprises a gear tooth and said biased member is urged into contact with said gear tooth.

7. The downhole ratchet of claim 6, wherein said biased member is mounted for pivotal or axially movement.

8. The downhole ratchet of claim 5, wherein said first member comprises a first gear and said biased member comprising a second gear, said first gear and said second gear engaging each other to drive said drilling string, said first gear and said second gear being moveable away from each other when said lower tubular rotates faster than said upper tubular.

9. A method for controlling torsional oscillations in a drill string, said drill string extending from the surface to a drill bit, said method comprising the steps of:

mounting a ratchet at a downhole position within said drill string, said ratchet transferring torque to said drill string below said ratchet when said drill string below said ratchet rotates at less than a velocity of said drill string above said ratchet, said ratchet permitting said drilling string below said ratchet to further rotate with respect to said drill string above said ratchet when said drill string below said ratchet rotates faster than a velocity of said drill string above said ratchet.

10. The method of claim 9, further comprising said drill string comprises a BHA (bottom hole assembly) and a drill pipe portion;

said BHA being at a lowermost position in said drill string, said BHA comprising a bit and components comprising one or more of a bit sub, drill collar, heavyweight drill collar, heavy weight drill pipe, stabilizer, reamer, shock, hole opener, downhole motor, rotary steerable system, directional equipment, drilling while measurement equipment, steering unit, near bit inclination or a non-magnetic drill collar, said BHA being connected to said drill pipe portion of said drill string; and said drill pipe portion comprising one or more of a drill pipe, coiled tubing, heavyweight drill pipe, or a stabilizer.

11. The method of claim 9, further comprising said ratchet comprises a gear tooth and a biased member that is urged into contact with said gear tooth.

12. The method of claim 11, further comprising mounting said biased member to be pivotal or axially moveable.

13. The method of claim 9, further comprising providing that said ratchet comprises a first gear and a biased member wherein said biased member comprises a second gear, providing that said first gear and said second gear engage each other to drive said drill string, and providing that said first gear and said second gear are moveable with respect to each other when said drill string below said ratchet rotates faster than a velocity of said drill string above said downhole position.

* * * * *